US008908478B2

(12) United States Patent
Heeringa et al.

(10) Patent No.: US 8,908,478 B2
(45) Date of Patent: Dec. 9, 2014

(54) TAP SENSITIVE ALARM CLOCK

(75) Inventors: Schelte Heeringa, Sneek (NL); Roelof Jan Wind, Eerste Exloermond (NL); Frans Wiebe Rozeboom, Haren (NL); Jacob Hendrik Botma, Leeuwarden (NL); Hielke Simon Van Oostrum, Drachten (NL); Michiel Allan Aurelius Schallig, Drachten (NL); Robert Godlieb, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/816,264

(22) PCT Filed: Aug. 4, 2011

(86) PCT No.: PCT/IB2011/053469

§ 371 (c)(1),
(2), (4) Date: Feb. 11, 2013

(87) PCT Pub. No.: WO2012/020356

PCT Pub. Date: Feb. 16, 2012

(65) Prior Publication Data

US 2013/0135973 A1 May 30, 2013

(30) Foreign Application Priority Data

Aug. 12, 2010 (EP) ..... 10172670

(51) Int. Cl.

| | |
|---|---|
| ***G04C 23/00*** | (2006.01) |
| ***G04B 23/02*** | (2006.01) |
| ***G04C 21/00*** | (2006.01) |
| ***G04B 21/00*** | (2006.01) |
| ***G04C 21/16*** | (2006.01) |
| ***G04G 13/02*** | (2006.01) |
| ***G04G 21/08*** | (2010.01) |

(52) U.S. Cl.
CPC ..... *G04G 21/08* (2013.01); *G04G 13/023* (2013.01); *G04G 13/028* (2013.01)
USPC ..... 368/72; 368/243; 368/245

(58) Field of Classification Search
CPC .... G04G 21/023; G04G 21/028; G04G 21/08
USPC ..... 368/72, 73, 76, 255, 245
See application file for complete search history.

(56) References Cited

U.S. PATENT DOCUMENTS 3,631,450 A * 12/1971 Chalfant ..... 368/245
4,078,376 A 3/1978 Freeman (Continued)

FOREIGN PATENT DOCUMENTS

EP 1406133 A2 4/2004
EP 1833103 A1 9/2007

(Continued)

*Primary Examiner* — Amy Cohen Johnson
*Assistant Examiner* — Daniel Wicklund

(57) ABSTRACT

A tap sensitive alarm clock has a housing (20), a vibration sensor (22) mechanically coupled to the housing for receiving a shock due to a user tapping the housing, and a control circuit (24) coupled to the vibration sensor for controlling a function of the alarm clock. An audio unit (26) is coupled to an audio circuit (25) for generating sound, e.g. a loudspeaker in an alarm clock or a wake up light. To avoid interference of the sound and the vibration sensor, the alarm clock is provided with a filter (23) coupled to the vibration sensor and the control circuit. The filter has a filter curve matched to block frequencies occurring in the sound. Advantageously it is avoided that the sound frequencies trigger the function, while the sensor is sensitive to other frequencies up to the frequency range of the sound for reliably detecting the tapping.

13 Claims, 5 Drawing Sheets

(56) References Cited

U.S. PATENT DOCUMENTS

| | | | | |
|---|---|---|---|---|
| 4,233,679 | A * | 11/1980 | Schwarzschild | 368/72 |
| 5,054,007 | A * | 10/1991 | McDonough | 367/139 |
| 5,095,468 | A * | 3/1992 | Sato | 368/72 |
| 5,243,327 | A * | 9/1993 | Bentz et al. | 367/139 |
| 6,002,336 | A * | 12/1999 | Widding et al. | 340/573.1 |
| 6,396,402 | B1 * | 5/2002 | Berger et al. | 340/573.2 |
| 6,477,117 | B1 | 11/2002 | Narayanaswami et al. | |
| 6,491,647 | B1 * | 12/2002 | Bridger et al. | 600/585 |
| 6,577,559 | B1 * | 6/2003 | Fleury et al. | 368/255 |
| 6,813,223 | B1 * | 11/2004 | Born et al. | 368/255 |
| 2007/0211577 | A1 * | 9/2007 | Chan | 368/243 |
| 2010/0278016 | A1 * | 11/2010 | Sandu et al. | 368/256 |

FOREIGN PATENT DOCUMENTS

| | | | |
|---|---|---|---|
| EP | 1855170 | A2 | 11/2007 |
| JP | 61191983 | A | 8/1986 |
| JP | 61195387 | A | 8/1986 |
| JP | 61205891 | A | 9/1986 |
| JP | 61234386 | A | 10/1986 |
| WO | 2009070758 | A1 | 6/2009 |

* cited by examiner

TAP SENSITIVE ALARM CLOCK

FIELD OF THE INVENTION

The invention relates to a tap sensitive alarm clock, comprising a housing, a vibration sensor mechanically coupled to the housing for receiving a shock due to a user tapping the housing, and a control circuit coupled to the vibration sensor for controlling a function of the alarm clock.

BACKGROUND OF THE INVENTION

Document EP 1 833 103 describes a shock-activated switch device, which comprises a piezoelectric buzzer having a body for receiving a mechanical shock and a terminal for outputting an electrical output signal when the body receives a mechanical shock. The shock is provided by a user tapping the housing of the device. An output circuit is connected to the terminal for converting the output signal into a logic signal for controlling an electronic circuit to execute a specific programmable function, such as alarm snooze.

SUMMARY OF THE INVENTION

A tap sensitive alarm clock, like the above shock sensitive device, has a vibration sensor, but may also have an audio unit for generating a sound, such as a buzzer or a loudspeaker. It appeared that the tapping function of such a tap sensitive alarm clock having an audio unit is not reliable, for example, in that the snooze function is sometimes activated unintentionally.

It is an object of the invention to provide a tap sensitive alarm clock having an audio function, wherein the above mentioned problem does not occur or is at least prevented to a large extent.

For this purpose, according to a first aspect of the invention, the alarm clock as described in the opening paragraph comprises an audio unit coupled to an audio circuit for generating sound, and a filter coupled to the vibration sensor and the control circuit, the filter having a filter curve matched to filter frequency components that are present in the sound, so that only frequency components caused by the mechanical shock acting on the vibration sensor are passed to the control circuit.

The measures have the effect that the sensitivity of the tap function to mechanical shock is enhanced by the filter. The filter curve is made to block frequencies occurring in the sound. Hence the filter filters frequency components that are present in the sound, so only frequency components caused by the mechanical shock acting on the vibration sensor are passed to the control circuit. The sensitivity to frequency components caused by said tapping may be increased to a required level without increasing the risk of accidental activation by the sound. Advantageously, the sound, when produced, will not trigger the control circuit to activate the respective function of the alarm clock, for example a snooze function of an alarm clock, while frequency components of the shock outside the frequency band of the audio unit are passed by the filter and will contribute to triggering the function.

The invention is also based on the following recognition. Existing shock sensors may be activated by mechanical shocks caused by tapping a housing of an alarm clock. The existing sensors may be made to be sensitive to a frequency range caused by such shocks. However, the inventors have seen that such a frequency range, i.e. inherent to a sensor or a shock to be detected, may have a substantial overlap with the frequency range of sound produced by commonly used audio units in consumer devices, e.g. a loudspeaker in the alarm clock. Furthermore, the inventors have seen that the sensitivity of such a sensor may be limited to a selected range of frequencies occurring due to tapping, while a part of the range that overlaps is excluded. Although some part of the signal due to tapping is now filtered away, the frequency components that remain, i.e. that are passed via the filter, are surprisingly still quite sufficient for detecting said tapping. So said selected range is matched to the audio frequency range of the audio unit that is used in the alarm clock. For example, in many applications the audio frequency range does not have low-frequency components, while sufficient low-frequency components do occur due to tapping. Non-overlapping ranges for sound and for detecting tapping can be practically found, and the filter curve is matched to distinguish between said tapping and the sound.

In an embodiment of the alarm clock, the filter is a low-pass filter. The filter curve of the low-pass filter is easily matched to block the sound frequency range by selecting an appropriate corner frequency. Frequencies above the corner frequency are blocked, i.e. attenuated increasingly with increasing frequency above the corner frequency. It is noted that the low-pass filter may be combined with a high-pass filter having a high-pass corner frequency below the low-pass corner frequency of the low-pass filter, the combined filter also being called a band-pass filter. A practical value for the low-pass corner frequency is between 50 Hz and 200 Hz, e.g. 100 Hz. This has the advantage that sound frequencies are effectively blocked, while the frequency range to which the sensor responds is maximized without overlapping the audio range.

In an embodiment of the alarm clock, the vibration sensor is arranged for generating an electrical signal that is coupled to the filter, and the filter is arranged for processing the electrical signal. This has the advantage that electrical signals can be easily processed by electronic circuits and/or digital signal processing for filtering according to any desired filter curve.

In an embodiment, the vibration sensor is mechanically arranged so as to be sensitive according to the filter curve. The mechanical construction of the sensor may be designed to be inherently sensitive to a specific frequency range, e.g. a spring and/or mass may be provided to respond to specific frequencies. Also mechanical components may be provided to cooperate with the sensor to filter the sound, e.g. damping material. Hence, the mechanical structure may constitute the filter, or at least part of the filter. The mechanical filtering may be combined with an electrical filter circuit to optimize the filter curve.

In an embodiment of the alarm clock the filter has an adjustable amplification. This has the advantage that the sensitivity can be adjusted, e.g. to the environment or noise level of the alarm clock. In a further embodiment, the filter is arranged for adjusting the amplification in dependence on the level of the sound. Advantageously, the disturbance of the sound is reduced when the sound level is high, while the sensor is more sensitive when the sound level is low.

In an embodiment of the alarm clock the filter is arranged for adjusting the filter curve in dependence on the audio content of the sound. This has the advantage that the filtering is adjusted to the sound actually generated. In a further embodiment, the filter is a low-pass filter having a corner frequency and is arranged for adjusting the corner frequency in dependence on the audio content of the sound. The actual content of the sound is used for setting the corner frequency. Advantageously, the sensor is more sensitive when the sound contains fewer low-frequency components.

In an embodiment of the alarm clock the audio circuit comprises a high-pass filter having a high-pass filter curve to control the frequencies occurring in the sound. This has the advantage that the contents of sound are controlled so that fewer low-frequency components are generated.

Further preferred embodiments of the alarm clock according to the invention are given in the appended claims, disclosure of which is incorporated herein by reference.

BRIEF DESCRIPTION OF THE DRAWINGS

These and other aspects of the invention will be apparent from and elucidated further with reference to the embodiments described by way of example in the following description and with reference to the accompanying drawings, in which.

The Figures are purely diagrammatic and not drawn to scale. In the Figures, elements which correspond to elements already described may have the same reference numerals.

DETAILED DESCRIPTION OF EMBODIMENTS

Figure 1:
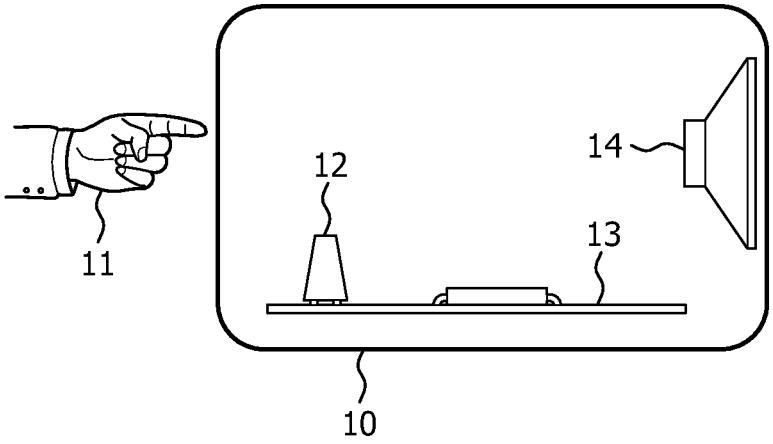
FIG. 1 shows a tap sensitive alarm clock.

FIG. 1 shows a tap sensitive alarm clock. The alarm clock has a housing 10. A user may tap on the housing to activate a function of the alarm clock, as indicated by a user's hand 11, in any appropriate way (slamming, banging, knocking, etc). Thereby a mechanical shock is applied to the housing. A vibration sensor 12 is mechanically coupled to the housing, e.g. by locating the sensor on the inside against a wall or against an inner element of the housing. In the Figure, the sensor is located on an electronic circuit board 13 that is mechanically attached to the housing. The function of the electronic board according to the invention is discussed in detail with reference to FIG. 2, and may further comprise any known function for an alarm clock operated by a human user. Also devices similar to the alarm clock, like a kitchen appliance, a gaming device, etc may be provided with the tap sensitive function according to the invention. The device further has an audio output element such as a loudspeaker 14 or a buzzer. The audio unit is connected to an audio circuit, e.g. also located on the electronic circuit board 13. At least one function of the device is activated based on the vibration sensor detecting said mechanical shock due to the tapping action on the housing, e.g. a snooze function or a function to switch to a different sound, or to a different radio station.

Alarm clocks generally have a 'snooze' function. At the set alarm time, when the alarm sounds, the user can activate this snooze function to silence the alarm clock for a time period, thereby delaying the alarm and enabling a further time of snoozing in bed. This time period is generally in the order of 5 to 10 minutes.

Activating the snooze function is generally done by pressing a button or control on the product. These buttons are often styled large and easily accessible.

To further maximize the accessibility of the snooze function, a sensor is used to detect a 'tap' anywhere on the product. This is accomplished by building into the product a vibration sensor or an accelerometer. Usually an alarm clock also contains a sound generating function, for the alarm and/or for rendering music from e.g. a radio. The vibrations generated from this sound source can interfere with the detection of user taps on the product.

Mechanical isolation between sound source and sensor will make said detection more robust; however, the levels of reliability that can be achieved this way are limited. The tap sensor needs to be mechanically connected to the outside of the product, by nature of its function. It is not practicable to disconnect the sound generating function from the housing, as any speaker driver needs the mass of the product or sound box assembly to maintain output quality and volume.

It is proposed to enable robust tap detection by matching the sensitivity of the sensor to the limited bandwidth of the sound source such as a speaker. To this end, the electronic circuit 13 is provided with a filter, and/or the sensor is mechanically arranged to the filter. The filter has a filter curve that is matched to be complementary to the frequency range of the audio unit. Usually in clock radios a small speaker is used. Due to its small size this speaker is not able to generate a high sound volume at low frequencies. A tap against the alarm clock generates a signal inter alia containing lower frequencies than the speaker can produce. By filtering out the high frequencies from the tap sensor signal the remaining signal will only contain tap information.

Figure 2:
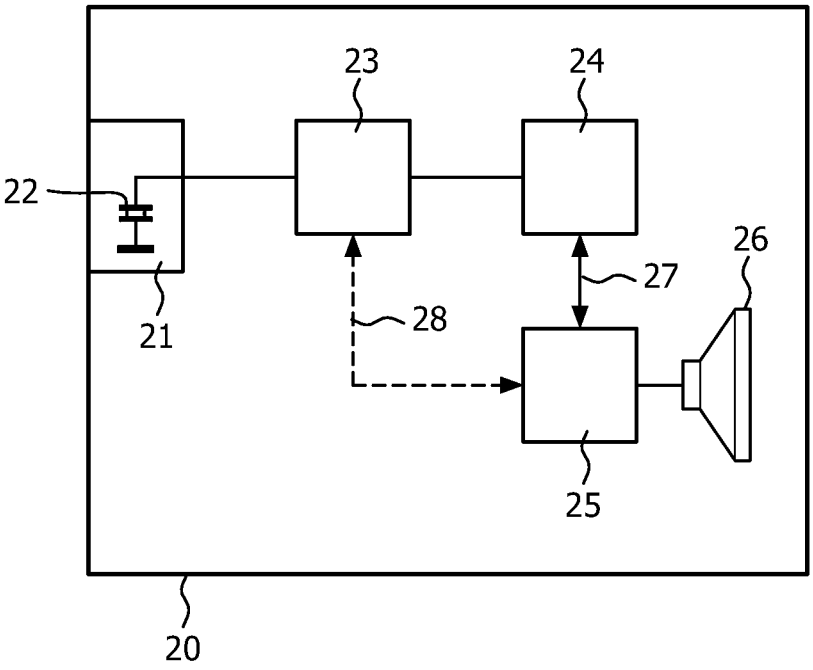
FIG. 2 shows a tap sensitive alarm clock having a filter.

FIG. 2 shows a tap sensitive alarm clock having a filter. The alarm clock has a housing 20, on which a user may tap to activate a function of the alarm clock. A vibration sensor 22 is mechanically coupled to the housing, e.g. by locating the sensor at a sensor mount 21 connected to, or being part of, the housing. The sensor is coupled to an electronic circuit, in particular to a filter 23. Hence, the vibration sensor generates an electrical signal that is coupled to the filter, and the filter is arranged for processing the electrical signal. The output of the filter is coupled to a control circuit 24, which detects the filtered signal from the vibration sensor and activates a function of the alarm clock as indicated by arrow 27. The control circuit may also provide a signal to an external interface for controlling an external function.

In an embodiment the filter is at least partly constituted by mechanical elements. For example, the vibration sensor may be mechanically arranged so as to be sensitive according to the filter curve. A sensor may be applied which is inherently not sensitive to high frequencies due to its construction. The mechanical construction of the sensor may be designed to be inherently sensitive to a specific frequency range, e.g. a spring and/or mass may be provided to respond to specific frequencies, as described below. Also mechanical components may be provided to cooperate with the sensor to filter the sound, e.g. damping material that selectively dampens frequencies from the audio unit. Furthermore, the mechanical filtering may be combined with an electrical filter circuit to optimize the filter curve.

The alarm clock further comprises an audio circuit 25, e.g. an MP3 player, a clock and/or a radio circuit. The alarm clock further has an audio output unit 26 such as a loudspeaker. The audio unit is connected to the audio circuit.

The filter is designed to pass frequencies generated by said tapping action, while blocking frequencies produced by the audio unit. In an embodiment the filter is a low-pass filter. The low-pass filter curve is set to block frequencies occurring in the sound produced. The speaker will generate (substantially) no frequencies below the speaker bandwidth, usually starting somewhere between 50 and 200 Hz. In practice, the filter curve may have a corner frequency of 100 Hz.

Figure 3:
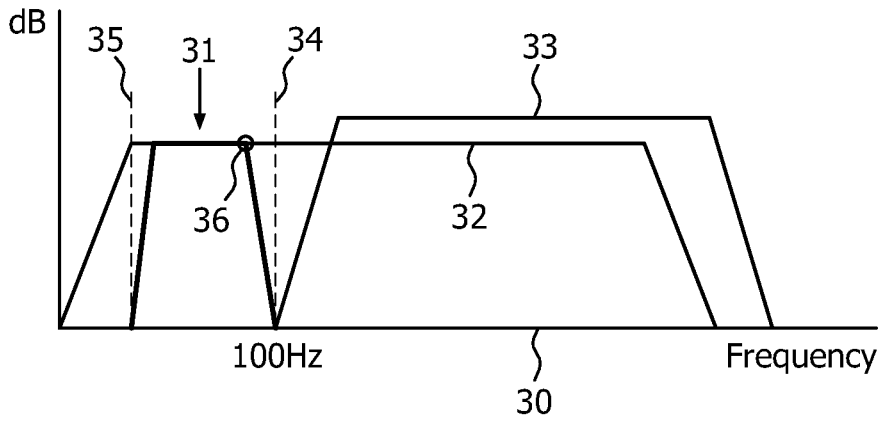
FIG. 3 shows a filter curve.

FIG. 3 shows a filter curve. The Figure shows a graph 30 of frequency versus amplitude for sound and mechanical shock. A first curve 33 shows the frequencies occurring in the sound, or the speaker bandwidth. It is noted that frequencies below a boundary 34 of 100 Hz do not occur, i.e. levels of such frequencies are below a predetermined low level. A second curve 32 shows frequencies in an unfiltered tap sensor signal. It is to be noted that the tap frequency range has a substantial overlap with the speaker frequency range. A third curve 31 shows a filter curve for the filter to be applied to the tap sensor signal. The curve has a low-pass characteristic; frequencies above a corner frequency 36 are attenuated. Only low frequency components from the tap signal are used for tap detection. In this way the tap function can be very sensitive without being falsely triggered by audio signals generated by the alarm clock itself.

In an embodiment the filter curve may also have a lower corner frequency for providing a high-pass function for very low frequencies. Although such frequencies may be generated by tapping, other sources may also generate such frequencies (like traffic, or tilting the alarm clock). Frequencies below a lower boundary 35 are assumed to be of little value for robustly detecting said tapping, and are therefore filtered out. Hence, at very low frequencies it is desirable that the sensitivity of the vibration sensor decreases, otherwise the sensor may act as a tilt sensor. Also the sensitivity of the sensor should be adjustable to a desired level. A too sensitive device would easily react on e.g. traffic passing by or merely touching the alarm clock. If the tap function is too insensitive it cannot be conveniently activated, and does not bring benefit for the user.

In an embodiment the filter is arranged for adjusting the amplification in dependence on the level of the sound for setting the sensitivity. The amplification may be set based on the actual sound produced, or on a user setting of audio volume.

In a further embodiment, the filter is arranged for adjusting the filter curve in dependence on the audio content of the sound produced, as indicated by dashed arrow 28 in FIG. 2. The audio content is analyzed, e.g. for detecting the presence of specific low-frequency components, and the filter curve is adjusted correspondingly to eliminate such components. For example, the filter may be a low-pass filter having a variable corner frequency and be arranged for adjusting the corner frequency in dependence on the audio content of the sound. Alternatively, a part of the audio signal may be coupled to the filter to be subtracted from the sensor signal, to actively eliminate sound components arriving at the sensor from the audio unit. The audio signal may be filtered and/or delayed to substantially imitate the transfer function from the audio unit to the vibration sensor signal.

In an embodiment, the audio signal of the audio unit is filtered also. If the bandwidth of the speaker extends too much towards lower frequencies, the audio signal can be filtered by a high-pass filter first in order to obtain the desired frequency response from the speaker. Hence, the audio signal to the speaker is first fed through a high-pass filter; the audio circuit comprises a high-pass filter having a high-pass filter curve to control the frequencies occurring in the sound.

In a practical embodiment the vibration sensor is a standard piezo disc, which may also be used as buzzer. The vibration sensor signal now is the piezo signal, which is amplified and filtered. Amplification is needed in order to make the signal level compatible with (digital) microcontroller inputs. The low-pass filter has a corner frequency of typically 100 Hz and a slope of 12 dB per octave. The decreasing tap sensitivity at very low frequencies is realized by the internal capacitance of the piezo sensor combined with the input resistance of the amplifier. The filter may be implemented in several ways:

The electrical signal can be filtered by an electronic circuit consisting of passive components or active filters;

The electrical signal can be filtered by sampling the signal and using a digital filter, implemented in hardware or software;

By a combination of the above options.

In an embodiment, for optimal sensitivity, the amplification is dynamically adjusted in dependence on the audio content. At higher audio levels the amplification will be decreased. Furthermore, for optimal sensitivity, the corner frequency of the low-pass filter can be dynamically adjusted, dependent on the audio content.

Figure 4:
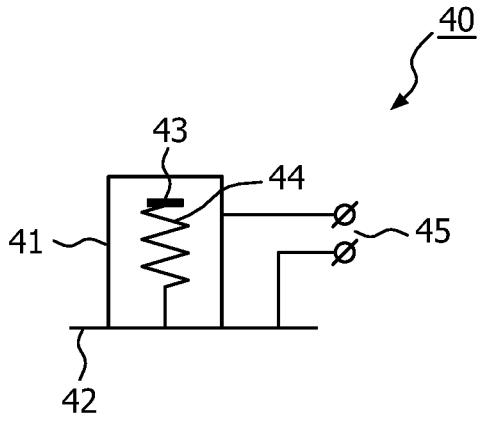
FIG. 4 shows a vibration sensor having a mechanical filter.

FIG. 4 shows a vibration sensor having a mechanical filter. The sensor 40 has a first electrode 41 and a second electrode 42 connected to an output 45. A mass 43 is positioned on a spring 44. The sensor may establish contact between both electrodes at a shock of a suitable strength and frequency. The mass/spring system in the sensor has a predetermined frequency behaviour that can be set by the respective mass and strength of the spring. The frequency response may be further optimized by applying damping and or secondary resilient elements, or a specific mechanical coupling to the housing.

Figure 5:
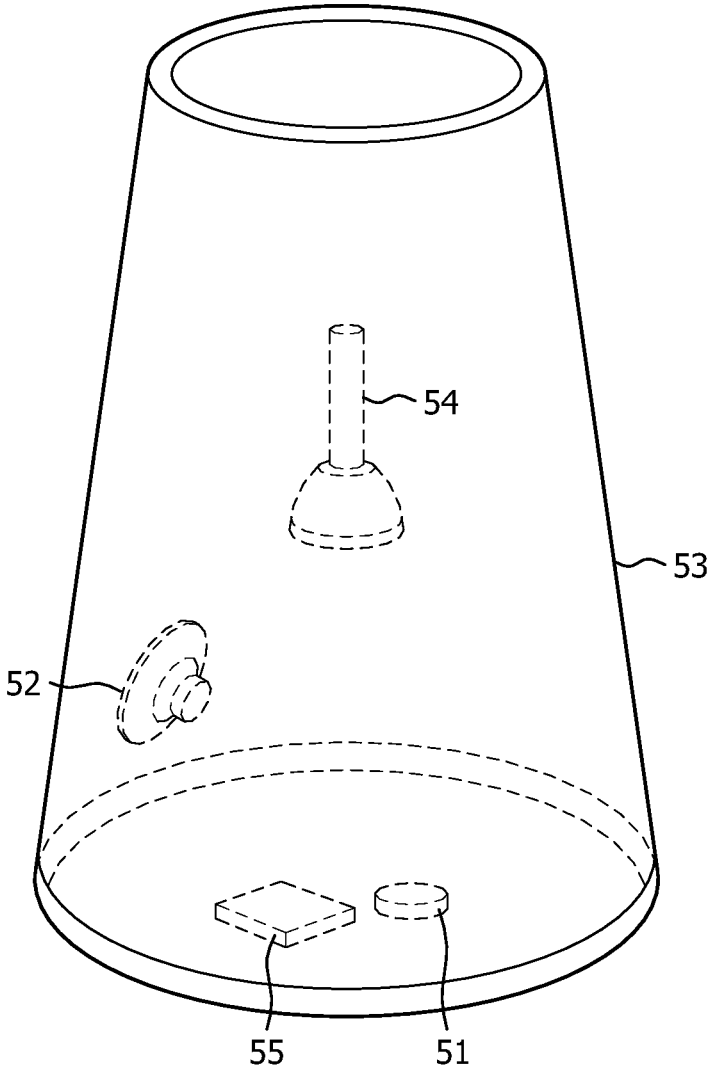
FIG. 5 shows a wake up light.

FIG. 5 shows a wake up light. The wake up light is an example of the tap sensitive alarm clock as described above, having a vibration sensor 51 coupled to an electronic unit 55. A speaker 52 is coupled to an audio circuit for generating sound, and a lamp 54 is provided for generating light to awake the user. The vibration sensor is conveniently located at the bottom surface of the housing 53, which surface reliably vibrates whenever the alarm clock is tapped. The part of the housing which holds the sensor may be mechanically optimized to vibrate at a particular frequency in the pass band of the filter curve, e.g. by providing a suitable mass near the sensor.

Figure 6:
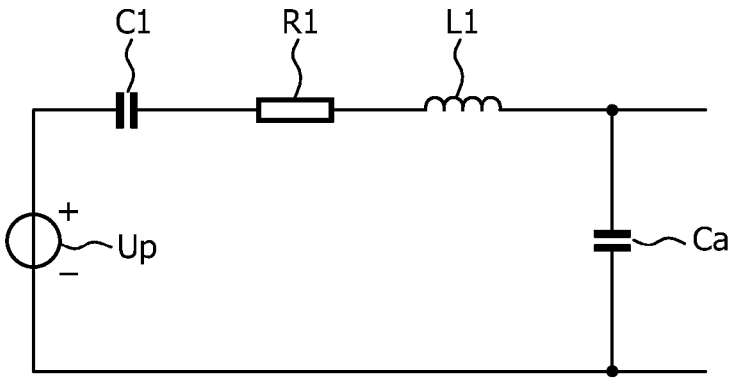
FIG. 6 shows an equivalent electrical scheme for a piezo sensor element.

FIG. 6 shows an equivalent electrical scheme for a piezo sensor element. The vibration sensor may be a standard piezo disc element, normally used for buzzers. The Figure shows the equivalent circuit diagram for such a piezo sensor. Capacitor Ca is the piezo capacitance. The capacitance of the piezo disc at low frequency is given by $$C_a = \frac{\varepsilon_0 \cdot \varepsilon_r \cdot A}{h}$$

where A=surface area, h=height of the piezo disc. A practical piezo diameter is 15 mm, and a measured piezo thickness h=0.25 mm. An estimation for the piezo capacitance $$C_a = \frac{8.85 \cdot 10^{-12} \cdot 2000 \cdot (7.5 \cdot 10^{-6})^2 \cdot \pi}{0.25 \cdot 10^{-3}} = 12.5 \text{ nF}$$

Capacitor C1 represents the "mechanical" capacitance of the spring constant of the piezo element. Inductor L1 represents the seismic mass and R1 represents the mechanical loss.

In an experiment, the capacitance measured at frequencies lower than the resonance frequency is equal to Ca//C1. At frequencies higher than the resonance frequency the capacitance measured is equal to Ca. R1 equals the damping resistance at the resonance frequency. Below resonance the capacitance measured is C1//Ca=14.5 nF. Above resonance the capacitance measured is Ca=12.3 nF, nicely matching the calculated capacitance for Ca. C1 can be calculated by subtracting Ca from the total capacitance:

$C1=14.5\text{ nF}-12.3\text{ nF}=2.2\text{ nF}.$ $R1\approx 1.5\text{ k}\Omega$ $f0\approx 7\text{ kHz}$ For frequencies much lower than f0 the inductance L1 can be neglected. Resonance occurs at 5-5.7 kHz for a piezo that is not mounted; resonance occurs at 7.5-8 kHz for the element mounted in a housing. There are also resonance peaks at 35 kHz and 135 kHz, but these are not of interest for the tap function.

Looking at the equivalent circuit of FIG. 6, a resonance peak can be expected at an increased damping resistance in dependence on mounting the piezo. The measured damping resistance is 2 kΩ. The resonance may shift to a higher frequency because the value of the spring capacitance decreases; the piezo has a lower elasticity due to the mounting. A higher piezo output signal may be achieved by a better mechanical coupling to the housing. A better mechanical coupling will dampen the resonance but will increase the output voltage of the sensor. Based on this insight, the piezo element must be tightly coupled to the housing. With glue beneath the whole piezo surface, this coupling can be achieved. Double-sided tape proved to be the best for attaching the sensor.

Figure 7:
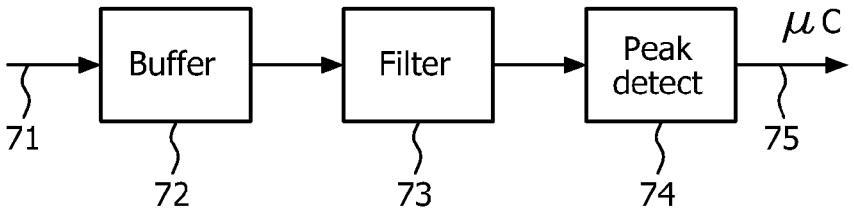
FIG. 7 shows a block diagram for a tap circuit.

FIG. 7 shows a block diagram for a tap circuit. An electronic tap detection circuit should amplify and filter the piezo signal. The piezo signal is coupled to a buffer circuit 72 via an input 71. The buffer is coupled to a filter 73, e.g. a low-pass filter and amplifier. The filtered signal is coupled to a peak detector 74, which may also clip the signal, to generate an output signal 75 to be coupled to a controller, e.g. a microprocessor. It is noted that the output signal may also be provided to an external interface of a tap sensitive alarm clock for activating an external function.

The buffer stage 72 provides a high impedance input for the piezo sensor. The piezo sensor has an internal capacitance of approximately 12 nF which, together with the input impedance of the buffer stage, forms a high-pass filter. The corner frequency of this filter should be below 100 Hz. This means that the input impedance of the buffer stage should be higher than $$Rin=\frac{1}{2\cdot\pi\cdot f\cdot C_{piëzo}}=\frac{1}{2\cdot\pi\cdot 100\cdot 12\cdot 10^{-9}}=132\text{ k}\Omega$$

The buffer stage is followed by the amplifier/filter 73 for eliminating frequencies above 100 Hz. Finally, the signal is made compatible with the microcontroller input by means of a peak detector/clipping stage 74. The clipping stage may consist of a base-emitter junction of a bipolar transistor. Since the piezo signal of FIG. 6 has an amplitude of 30 mV, the total amplification should be at least A=Vbe/30 mV=0.6/0.03=20.

Figure 8:
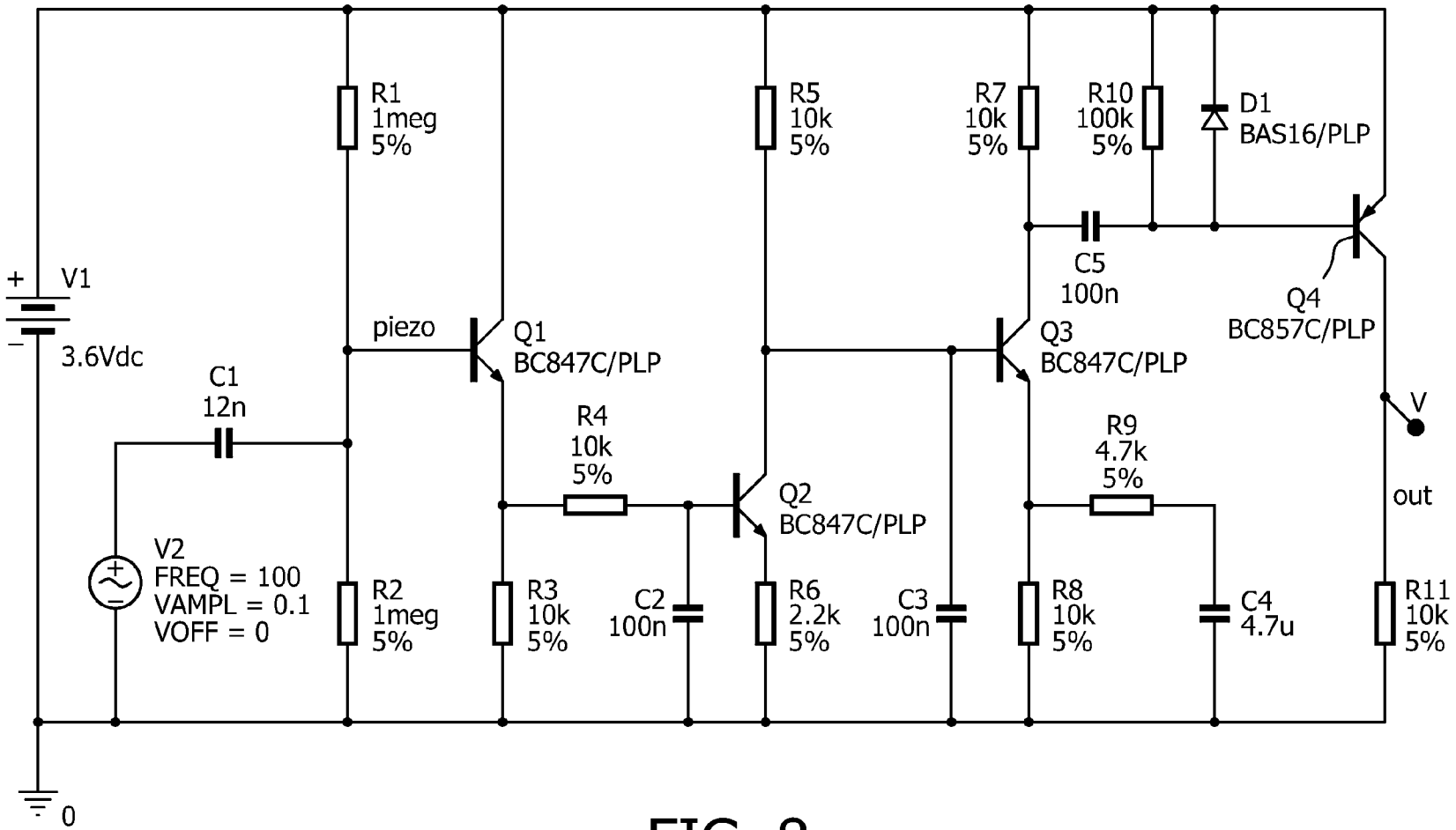
FIG. 8 shows a circuit diagram of the tap circuit.

FIG. 8 shows a circuit diagram of the tap circuit. First, the piezo signal is buffered by an emitter follower stage which has an input impedance of approximately R1//R2=500 kΩ well above the minimum value of 100 kΩ.

The emitter follower stage attenuates the signal by a factor of 0.93, partly caused by resistor R4 being in the same range as resistor R3. This can be slightly improved to 0.95 by increasing R4 to 100 k and decreasing C1 to 10 nF. A low-pass filter consisting of R4, C1 is connected to the output of the emitter follower stage. The −3 dB point is $$fc=\frac{1}{2\cdot\pi\cdot R4\cdot C1}=\frac{1}{2\cdot\pi\cdot 10k\cdot 100n}=159\text{ Hz}$$

After this first filter, the signal is amplified by Q2. The amplification of this transistor stage is determined by R5/R6=4.5, but in practice the amplification at 100 Hz is only 3. This deviation is partly caused by the attenuation of the filter. The bias voltage of Q2 equals $$VbiasQ2=\frac{R2}{R1+R2}\cdot V2-VbeQ1=\frac{1M}{1M+1M}\cdot 3.6-0.6=1.2\text{ V}$$

The current through R6 equals $$IR6=\frac{Vbias-VbeQ2}{R6}=\frac{1.2-0.6}{2200}=0.27\text{ mA}$$

The signal is filtered for a second time by R5, C2. Again the −3 dB frequency is 159 Hz.

After the second filter, the signal is amplified by Q3. For DC the amplification is R7/R8=1. For high frequencies the amplification is R7/(R8//R9)=10 k/449=22, but in practice the amplification is only 10. Q2 acts as a high-pass filter and starts to amplify at $$fc=\frac{1}{2\cdot\pi\cdot R9\cdot C3}=\frac{1}{2\cdot\pi\cdot 470\cdot 4.7\mu}=72\text{ Hz}$$

The advantage of setting the corner frequency between 50 Hz and 100 Hz is that the hum signal is slightly attenuated.

The bias voltage of Q3 is set by the Q2 stage:

$$VbiasQ3=V2-IR6\cdot R5=3.6-0.27\text{ m}\cdot 10\text{ k}=0.9\text{V}$$

The bias voltage across R7 and R8 is VbiasQ3−VbeQ3=0.9−0.6=0.3V.

The total amplification of the piezo signal is 3·10≈30, so the tap output is pulled high if the amplitude of the piezo signal is 20 mV. When the Q3 stage is loaded with VbeQ4, the amplification for high frequencies is decreased by low-pass filter R7, C4, which again has a corner frequency of 159 Hz. By adding diode D1, capacitor C4 is symmetrically charged and discharged. The presence of R10 prevents leakage currents triggering Q4.

Capacitor C4 removes the DC offset at the collector of Q3. Whenever the amplitude of the signal at the collector exceeds 0.6V, Q4 will start to conduct for a maximum time of one half cycle of the signal. The μC program only accepts pulses with a minimum width of 0.5 ms. Therefore, the maximum frequency which can be detected is 1 kHz. The RC- time of the combination R7, C4 is 1 ms and is already of influence at 1 kHz. Therefore, the maximum detection frequency will be lower than 1 kHz. In practice, the maximum detectable frequency (regardless of amplitude) is between 700-800 Hz.

The amplification of the electronic circuit can be adjusted by changing the value of resistor R9.

In summary, the invention provides an improvement of e.g. a snooze function of an alarm clock, for example as applied in a wake-up light. The user can activate the snooze function by tapping on the alarm clock. For this purpose a vibration sensor or an accelerometer is used which is arranged in the alarm clock to detect a tapping action. With such a snooze function, a problem occurs when the alarm clock has an audio function. The audio signals produced by the speaker may activate the snooze function, which is not desirable. It is proposed to solve this problem by using a low-pass filter that only passes the lower frequency signals produced by the vibration sensor or accelerometer. Usually the speaker has a limited speaker bandwidth and does not produce audio signals of a relatively low frequency (e.g. below 100 Hz). Tapping actions on the housing of the alarm clock generate a wide frequency range, which typically comprises lower-frequency components. By matching the low-pass-filter characteristics with the bandwidth of the speaker, the audio signals detected by the vibration sensor or accelerometer are filtered out of the sensor signal, so that it is prevented that the audio signals interfere with the detection of the tapping action and can influence the snooze function. Alternatively, a vibration sensor can be used that is not sensitive to higher frequencies, for example by using a suitably tuned mass-spring system to suspend the sensor relative to the alarm-clock housing.

It is to be noted that the invention may be implemented in hardware and/or software, using programmable components. It will be appreciated that the above description for clarity has described embodiments of the invention with reference to different functional units and processors. However, it will be apparent that any suitable distribution of functionality between different functional circuits or processors may be used without deviating from the invention. For example, functionality illustrated to be performed by separate units, processors or controllers may be performed by the same processor or controllers. Hence, references to specific functional units are only to be regarded as references to suitable means for providing the described functionality rather than indicative of a strict logical or physical structure or organization. The invention can be implemented in any suitable form including hardware, software, firmware or any combination of these.

It is noted that in this document the word 'comprising' does not exclude the presence of elements or steps other than those listed and the word 'a' or 'an' preceding an element does not exclude the presence of a plurality of such elements, and that any reference signs do not limit the scope of the claims. Further, the invention is not limited to the embodiments, and the invention lies in each and every novel feature or combination of features described above or recited in mutually different dependent claims.

The invention claimed is:

1. An apparatus comprising a tap-sensitive alarm clock including;

a housing;

a vibration sensor mechanically coupled to the housing for receiving a shock due to a user tapping on the housing, said shock including components in a first frequency range;

a control circuit coupled to the vibration sensor for controlling a function of the alarm clock;

an audio unit coupled to an audio circuit for generating sound including components in a second frequency range that overlaps an upper end of the first frequency range, said second frequency range including frequencies in said upper end of the first frequency range and frequencies higher than the first frequency range; and an adjustable a filter coupled to the vibration sensor and the control circuit, said filter being adjusted to limit passage from the vibration sensor to the control circuit of only the shock components having frequencies in the first frequency range that are not also in the second frequency range.

2. The apparatus as claimed in claim 1 wherein the filter comprises a low-pass filter.

3. The apparatus as claimed in claim 2 wherein the filter has a corner frequency between 50 and 200 Hz.

4. The apparatus as claimed in claim 1 wherein the vibration sensor produces an electrical signal that is provided to the filter and the filter is adapted to process the electrical signal in accordance with an adjusted bandwidth.

5. The apparatus as claimed in claim 1 wherein the vibration sensor is mechanically arranged so as to be sensitive according to a characteristic curve for the filter.

6. The apparatus as claimed in claim 1 wherein the filter has an adjustable amplification.

7. The apparatus as claimed in claim 6 wherein the filter is adapted to adjust the amplification in dependence on the level of the sound.

8. The apparatus as claimed in claim 1 wherein the filter is adapted to adjust a characteristic curve for the filter in dependence on the audio content of the sound.

9. The apparatus as claimed in claim 8 wherein the filter comprises a low-pass filter having a corner frequency and is adapted to adjust the corner frequency in dependence on the audio content of the sound.

10. The apparatus as claimed in claim 1 wherein the audio circuit comprises a high-pass filter for controlling the frequencies occurring in the sound.

11. The apparatus as claimed in claim 1, said apparatus comprising a wake-up light.

12. The apparatus as claimed in claim 1 wherein the function comprises a snooze function.

13. The apparatus as claimed in claim 1, said apparatus comprising a radio.

* * * * *